US006371787B1

(12) United States Patent
Branch et al.

(10) Patent No.: US 6,371,787 B1
(45) Date of Patent: Apr. 16, 2002

(54) PULL-TO-RELEASE TYPE LATCH MECHANISM FOR REMOVABLE SMALL FORM FACTOR ELECTRONIC MODULES

(75) Inventors: Scott M. Branch; David P. Gaio; Michael F. Hanley; William K. Hogan, all of Rochester, MN (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 09/801,320

(22) Filed: Mar. 7, 2001

(51) Int. Cl.[7] ..... H01R 6/27
(52) U.S. Cl. ..... 439/352
(58) Field of Search ..... 439/352, 353, 439/357, 358

(56) References Cited

U.S. PATENT DOCUMENTS 5,564,939 A * 10/1996 Maitani et al. ..... 439/352

5,779,495 A * 7/1998 Dechelette et al. ..... 439/352

* cited by examiner

*Primary Examiner*—Renee Luebke
*Assistant Examiner*—Briggitte R. Hammond
(74) *Attorney, Agent, or Firm*—Laurence R. Letson

(57) ABSTRACT

A latch mechanism using a natural unlatching, releasing, pull movement has a slidable latch release which is carried on a device being latched, such as an electronic module. This slidable latch release has a pair of recesses or cavities at least partially defining cams that engage and displace a latch member from engagement with a latching surface on the device being latched. A latch release member is provided with a pair of wing members that are resilient and are deformed as a result of movement of the latch release relative to the latched device. Deformation provides a bias to restore the latch release member to a position capable of permitting latching upon the reinsertion of the device into a host device, such as a computer or the like.

13 Claims, 6 Drawing Sheets

PULL-TO-RELEASE TYPE LATCH MECHANISM FOR REMOVABLE SMALL FORM FACTOR ELECTRONIC MODULES

CROSS REFERENCE TO RELATED UNITED STATES PATENT APPLICATIONS

The following are related co-pending United States patent applications:

- REMOVABLE SMALL FORM FACTOR FIBER OPTIC TRANSCEIVER MODULE CHASSIS, Ser. No. 09/489,870, filed Jan. 20, 2000, by Scott M. Branch, David P. Gaio and William K. Hogan;
- REMOVABLE LATCH AND BEZEL ELECTROMAGNETIC INTERFERENCE GROUNDING FEATURE FOR FIBER-OPTIC TRANSCEIVERS, Ser. No. 09/410,786, filed Oct. 1, 1999, by Scott M. Branch, David P. Gaio and William K. Hogan;
- REMOVABLE SMALL FORM FACTOR FIBER OPTIC TRANSCEIVER MODULE AND ELECTROMAGNETIC RADIATION SHIELD, Ser. No. 09/489,184, filed Jan. 20, 2000, by Scott M. Branch, David P. Gaio and William K. Hogan;
- PIVOTING TYPE LATCH FOR REMOVABLE ELECTRONIC DEVICES, Ser. No. 09/591,640, filed Jun. 9, 2000, by Scott M. Branch, Leland L. Day, David P. Gaio, Michael F. Hanley and William K. Hogan;
- PULL TYPE LATCH MECHANISM FOR REMOVABLE SMALL FORM FACTOR ELECTRONIC MODULES, Ser. No. 09/657,214, filed Sep. 7, 2000, by Scott M. Branch, David P. Gaio, Michael F. Hanley and William K. Hogan; and
- PULL TYPE LATCH MECHANISM FOR REMOVABLE SMALL FORM FACTOR ELECTRONIC MODULES, Ser. No. 09/669,624 filed Sep. 25, 2000 by Scott M. Branch, David P. Gaio, Michael F. Hanley and William K. Hogan, all of which are incorporated herein in their entireties by this reference.

FIELD OF THE INVENTION

This invention relates to the field of connecting cables or other devices to computers and, more specifically, to the latching of connectors and connections together to ensure reliable service and uninterrupted data transmission and reception.

BACKGROUND OF THE INVENTION

Increasingly, computers and servers are being interconnected with other computers and servers to form communications and data networks. Prodigious amounts of data and other communications are transmitted and received over such networks and require reliable connection of coaxial or fiber-optic cables either to the computer/server or to interface devices connected to the computer/server to insure continued and uninterrupted connections. In order to provide the services or data that a computer or server is intended to provide to the remote computers upon demand, networked computers or servers typically operate continuously, twenty-four hours a day.

Easy connection/disconnection and reliable cable connections are necessary to permit rapid, easy and reliable changing of cables as needs arise. One approach, which is rapidly becoming a standard within the industry, utilizes a transceiver module to receive signals from the network cable and to transmit signals to the computer or server, or vice-versa.

This type transceiver module may be designed in various versions, but all are compatible with the particular connector and port in a particular computer or server. Some transceivers can receive optical signals and output electronic signals to the computer and vice-versa. Other transceiver modules may be designed to receive electronic signals from the network cables and output or transmit computer compatible electronic signal and vice-versa. Transceiver modules are inserted into and connected to the data ports of a computer or server. The transceiver modules must be reliably latched into data ports and be retained against reasonable forces exerted on cables without being disconnected from the data ports. At the same time, the latching of the transceiver modules must not be so resistive to unintentional disconnection forces that the transceiver module is damaged if the cables are pulled excessively.

The latching devices preferably are disposed on the transceiver modules so that these latching devices are removed from the host device whenever the transceiver module is removed. Therefore, the latch itself cannot be left in the data port, unprotected as such, and face the possibility of breakage from impacts or forces exerted thereon. Such breakage is a problem presented by designs wherein the latch mechanism is not removed from the data port whenever a transceiver module is removed. Remaining as part of the host device, a latch release member is obviously exposed to damage as it will project from the host device without a protective device to shield the latch device.

The latch is designed and created to be an intentionally "weak link" in the retention apparatus to desirably protect from destructive forces, the more expensive components, such as a transceiver module; those forces include those exerted by a person tripping over the cables or pulling excessively hard on the cables.

OBJECTS OF THE INVENTION

It is an object of the invention to latch a modular device into a predetermined position or receptacle relative to a host device.

It is another object to the invention to enable a latch to hold the latched device in a latched condition pending release of the latching member from the modular device.

It is an additional object of the invention to effect latching of the latch mechanism as a part of an inserting motion.

It is still another object of the invention to effect unlatching as part of an extracting movement.

It is a still further object of the invention for the latch mechanism to be easily replaceable on the device being latched to the host device.

Other Objects of the Invention will become apparent from a complete understanding of the structural and operational aspects of the invention provided by the attached drawings and the Detailed Description of the Invention below.

SUMMARY OF THE INVENTION

This Summary of the Invention is intended to present a succinct and summary description of the invention and is not intended to be a basis for limiting of the invention in any manner.

An electronic module is latched to the host device by a latch spring with an inwardly turned end to engage a surface on the electronic module and block movement of the electronic module, thereby insuring that the electronic module remains inserted into and electronically engaged with the electronics within the host device. This connection allows the optical signals or other signals of a network not only to be received, converted and utilized by the host device but also to convert and transmit the signals of the host device to a form usable on the network.

The latch is formed of a portion of an electro-magnetic interference cage or shield or is fabricated of a resilient cantilevered member with an end thereof formed to create a latch portion extending substantially transverse to the axis of movement of the electronic module and disposable in the path of transverse surface, blocking movement of the electronic module in a disconnecting direction. The cantilevered member in the form of a beam spring may be separately formed and attached to some other rigid structure in the host device.

The latch is controlled to deflect and to release the electronic module for extraction or removal of the electronic module by a latch release member. The latch release member is attached to and carried by the electronic module in a manner that permits movement relative to the electronic module. The latch release member is preferably spring-biased to a retracted position which causes disengagement from the latch member, permitting the latch member to flex and restore to the effective, latching position.

The latch release member may be pulled in a natural removal or extraction direction to cause camming surfaces on the latch release member to engage and cam the latch member out of the path of the latching surface on the electronic module and permit the pulling of the latch release member to further pull the electronic module from engagement with and within the host device.

The latch release member is dislocated against the force of a restore spring arms extending from the body of the latch release member and are arranged to abut against a juxtaposed surface to better provide the extraction or removal force to the electronic module.

The invention permits release and removal of the electronic module from the host device and is accomplished by a natural pulling motion necessary to extract the electronic module.

The invention may be implemented into any type of module that must be latched into a host and must be removed from time to time.

A more complete understanding of the structure and operation of the latching mechanism of the invention may be gained from the attached drawings and the detailed description of the invention that follows.

DETAILED DESCRIPTION OF THE PREFERRED EMBODIMENT

OF THE BEST MODE FOR CARRYING OUT THE INVENTION

AS CONTEMPLATED BY THE INVENTORS

Figure 1:
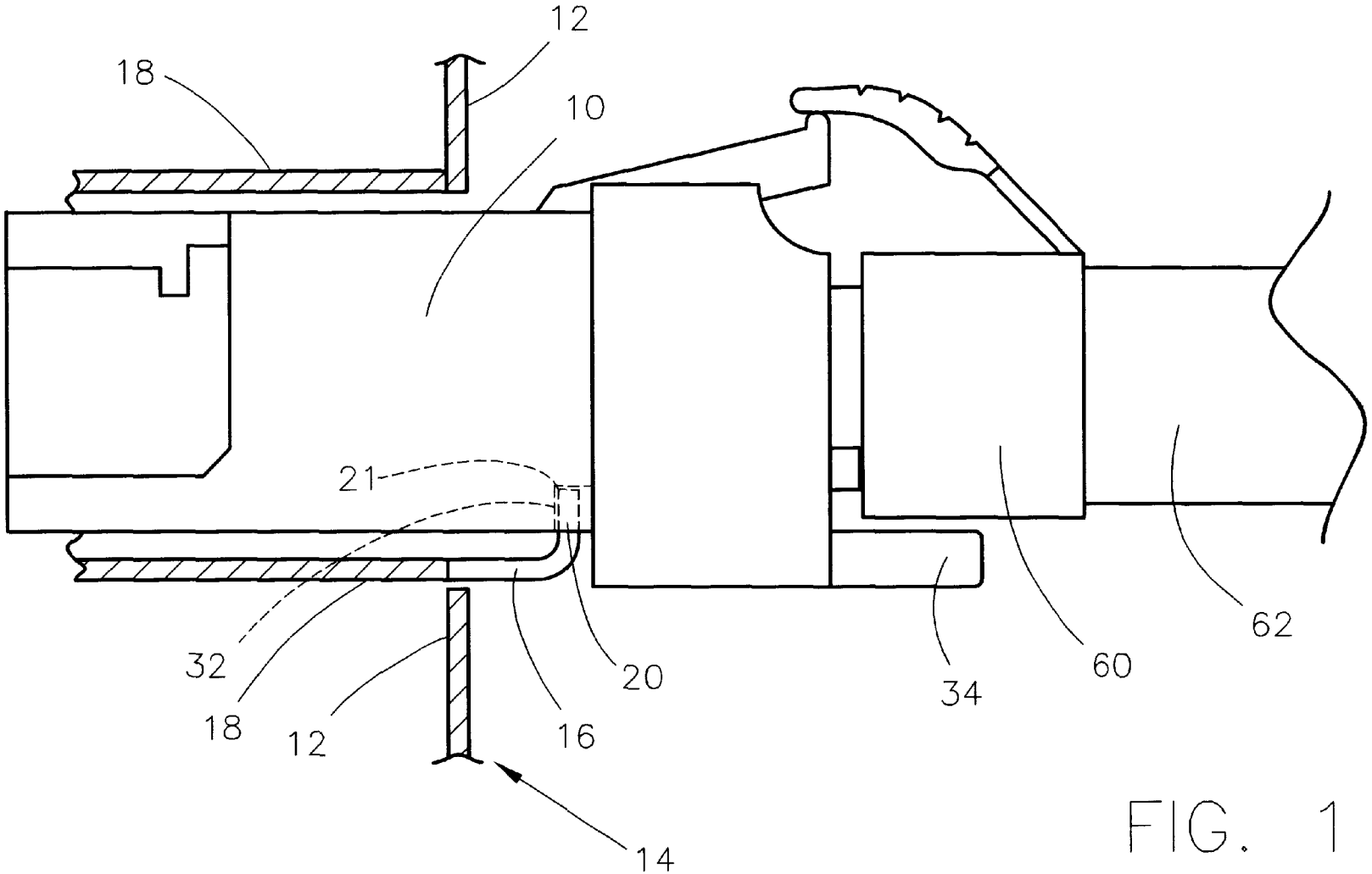
FIG. 1 is a side view of an electronic module carrying the latch mechanism of the invention disposed relative to a latch bar.

Referring to FIG. 1, the pull-to-release latch release member pull tab 34 is shown protruding from the transceiver module 10 and illustrates the transceiver module 10 latched into place by the latch member 16. The transceiver module 10 is shown inserted within the electro-magnetic interference shield or cage 18. A portion of the electro-magnetic interference cage 18 is formed both to be a cantilevered beam spring, functioning as latch member 16, and to deflect to permit passage of the transceiver module 10 upon insertion into the electro-magnetic interference cage 18.

Edge 21 of the upstanding portion or finger 20 of latch member 16 engages the transceiver module 10 to latch or retain the transceiver module 10 in the electro-magnetic interference cage 18 and is connected to the electronics (not shown) contained within the housing of the host device 14.

The transceiver module 10 is illustrated mated with a ferrule 60 on the end of a fiber optic cable 62. The fiber optic cable ferrule 60 is positioned above the pull-to-release latch member 34 to prevent ready access to the release member 34 while the fiber optic cable 62 is connected to the transceiver module 10 and presumably conveying optical signals to and from the transceiver module 10.

Latch member or retention member 16 engaged with the transceiver module 10 resists the unintentional disengagement of the transceiver module 10 from the host device 14 and the unintentional withdrawal of the transceiver module 10 through the bezel 12 of host device 14. Latch member 16 has an upstanding portion 20 which projects transverse to the path of movement of transceiver module 10 during insertion into and extraction from host device 14. The upstanding portion 20 of latch member 16 will engage the latch surface 32 formed into the transceiver module 10 to retain and prevent extraction of the transceiver module 10.

Figure 2:
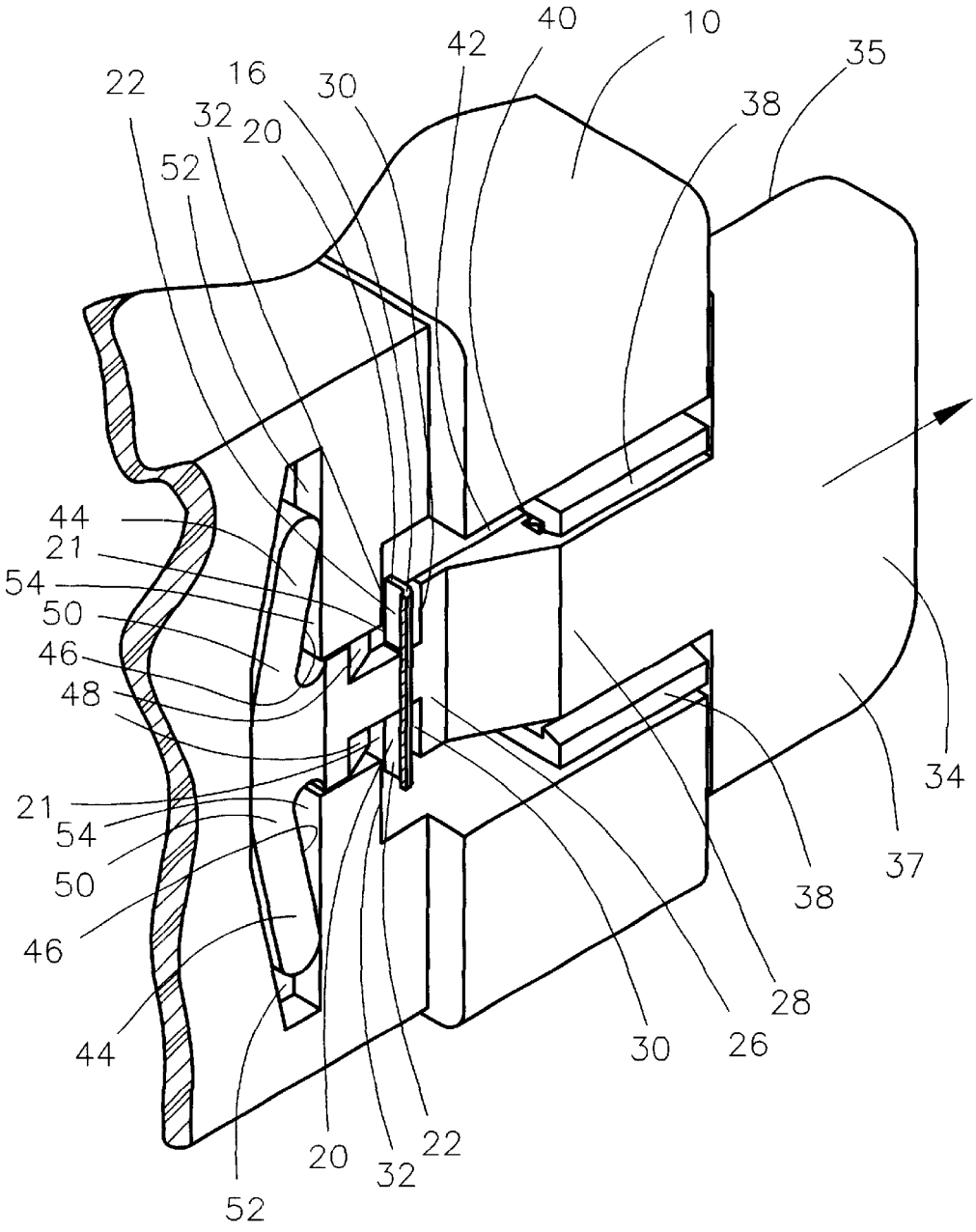
FIG. 2 is an isometric view of a portion of an electronic module and the latch release mechanism carried thereby.

FIG. 2 illustrates the pull-to-release member 34 extending from the exposed end of the transceiver module 10 and the arrow indicates the direction of movement of the latch release member 26 for accomplishing the release of the latched condition retaining the transceiver module 10, whenever the module 10 is inserted into the electro-magnetic interference cage 18 discussed above with reference to FIG. 1.

The transceiver module 10 is provided with slides 38 both to retain the latch release body 28 and to guide its movement thereof along a path parallel to the longitudinal axis of the transceiver module 10; this also permits movement of the latch release body 28 parallel to the axis of insertion and withdrawal of the transceiver module 10 into and out of the electromagnetic interference cage 18, shown in FIG. 1.

Figure 3:
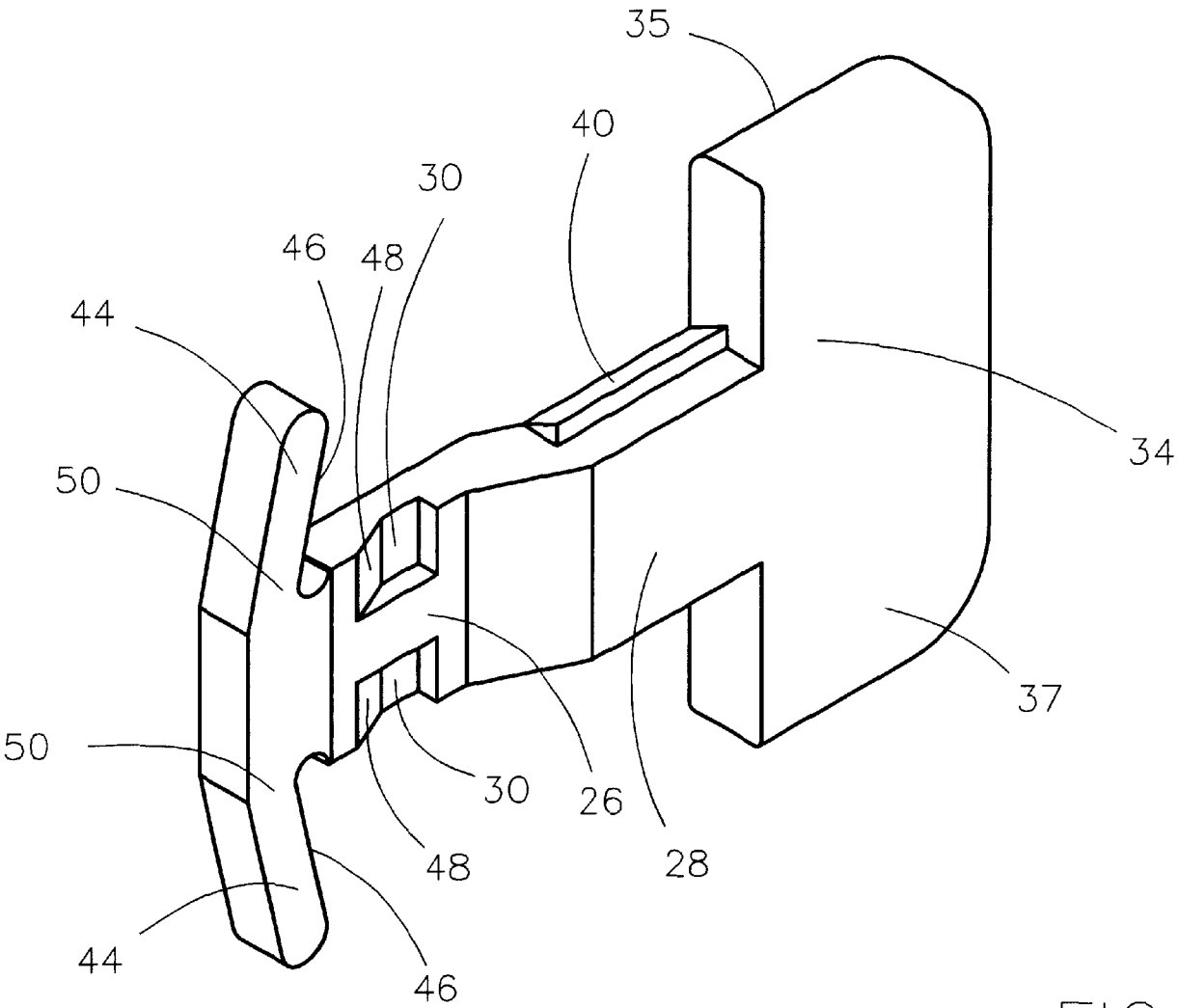
FIG. 3 is an isometric view of the exposed surface of the latch release member.

The underside of the pull-to-release member 26 is illustrated in FIG. 3. The latch release member 26 has a longitudinal body 28, a pull tab 34 on an exposed end and a spring member or spring arms 44 formed into the opposite end of the longitudinal body 28. The pull tab 34 is formed to permit engagement of its top surface 35 and bottom surface 37 thereof by the thumb and forefinger of a human hand. As illustrated in FIG. 1, the surfaces 35, 37 may be any of several different types such as smooth, ridged, textured, checkered or other suitable non-slip engageable surface textures to resist slippage of the thumb and forefinger, thereby insuring a good pulling grasp to unlatch the transceiver module 10 from the latch member 16 of the electro-magnetic interference cage 18 within the host device 14.

Again referring to FIGS. 2 and 3, the latch release member 26 is provided with recesses or cavities 30 in the exposed underside thereof. These recesses 30 are preferably disposed on opposing edges of the exposed side or under surface of the latch release member 26. This permits the reception into the recesses 30 of portions 20 of the latch member 16 extending from the electro-magnetic interference cage 18 as described earlier with reference to FIG. 1.

The distal end surface 48 of the recess 30 is formed to create sloping cam or ramp surfaces 48. The camming surfaces 48 may be engaged with the extending portions or fingers 20 of the latch member 16 that are resident within recesses 30 by a withdrawing movement of the latch release member 26. The camming surfaces 48 act to progressively force the fingers 20 of the latch member 16 out of the recesses 30 and out of interference with the latch surface 32 of the transceiver module 10 whenever the latch release member 26 is translated longitudinally relative to the transceiver module 10.

The fingers 20 are progressively displaced out of engagement with the transceiver module 10 and the spring arms 44 on the distal end of the longitudinal body 28 of the latch release member 26 are caused to flex at the flexure section 50 and act as springs. The spring arms 44 act to return and retain the latch release member 26 in its withdrawn or retracted position relative to the transceiver module 10 (FIG. 1) whenever there are no external forces exerted on the pull tab 34 of the latch release member body 28.

With the latch release member 26 fully retracted, the latch member 16 and, particularly, fingers 20 thereof are free to enter into the recesses 30 and dispose the fingers 20 of latch member 16 in blocking interference with the transceiver module 10, thereby preventing withdrawal of the transceiver module 10 from the electro-magnetic interference cage 18 and its connection with the host device 14.

Upon release of pulling forces on pull tab 34, latch release member 26 will be restored, due to the inherent resilience of spring arms 44, to its retracted position upon release of pulling forces on the tab 34.

Additionally, as best seen in FIG. 2, with the spring arms 44 resident in the slot-like recess 52 in the bottom of the transceiver module 10, and when the spring arms 44 deflect in response to the movement of the latch release member 26, the surfaces 46 of the spring arm members 44 and the surfaces 54 of the recess 52 engage and abut to limit travel of the latch release member 26. In addition to this limiting of longitudinal travel, the engagement of the spring finger surfaces 46 (shown in FIGS. 2, 3, and 4) and the transceiver module surfaces 54, in FIG. 2, provides a substantial resistance to further deflection of the spring arms 44. Consequently, such engagement both transfers substantially all of the force exerted on the pull tab 34 to the transceiver module 10 and also provides a very substantial force for extracting the transceiver module 10 from both the electro-magnetic interference cage 18 and those retaining frictional forces exerted on the transceiver module electronic connector (not shown).

Figure 4:
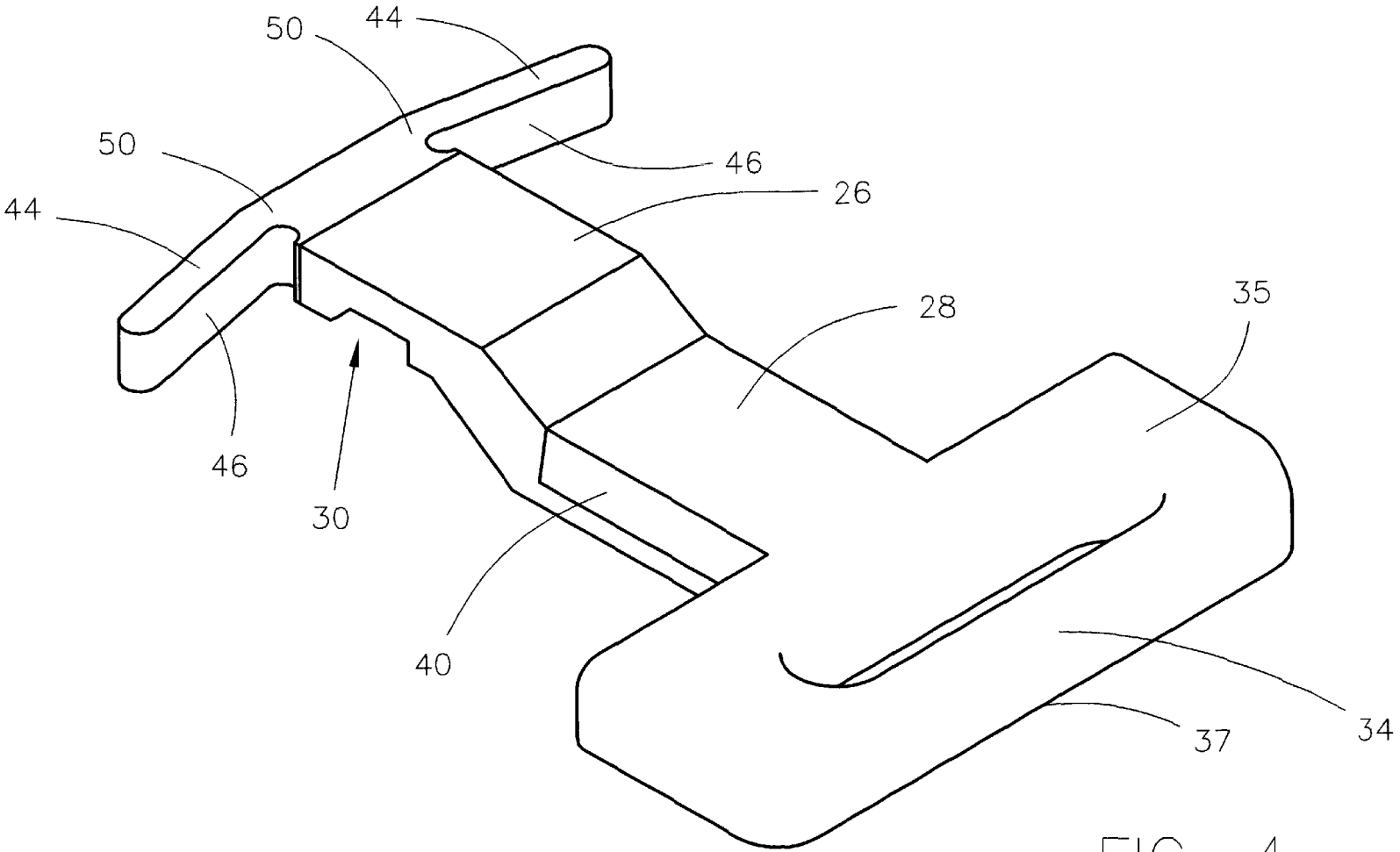
FIG. 4 is an isometric view of the latch release member from the external grip end thereof.

The latch release member 26 is illustrated in detail in FIGS. 3 and 4. The latch release member 26 is provided with slide members 40. The slide members 40 guide and stabilize the latch release member 26 during movement of the latch release member 26 relative to the transceiver module 10. As can be observed in FIG. 2, the form of the slide members 40, being wedge-shaped projections from the latch release member body 28, permits easy insertion of the latch release member 26 into the slide channel 42 formed by the transceiver module 10.

Typically, the slide channel 42 is formed into the transceiver module 10 as a part of the molding operation which results in the transceiver module 10 and provides the retention function necessary for the relative movement of the latch release member 26 and the transceiver module 10. The recess or cavity 52 that accepts the spring arms 44 likewise is molded into the transceiver module 10.

As shown in FIGS. 3 and 4, the latch release member 26 is assembled to the transceiver module 10 by forcing the body 28 of the latch release member 26 between the slides 38 that form a portion of the slide channel 42 of transceiver module 10, spreading the slides 38 and forcing the wedge-shaped slides 40 on the sides of the latch release member body 28 until the slides 40 pass over the slides 38, and the slides 38 snap back to shape. Similarly, a broken or damaged latch release member 26 may be removed by spreading the slides 38 and removing the broken or defective latch release member 26 between the slides 38. Thereafter, a new latch release member 26 may be inserted as previously described, and the significantly more expensive transceiver module 10 may be returned to service by the operator or other relatively unskilled person without the assistance of a technician and the cost of a service call.

Figure 5:
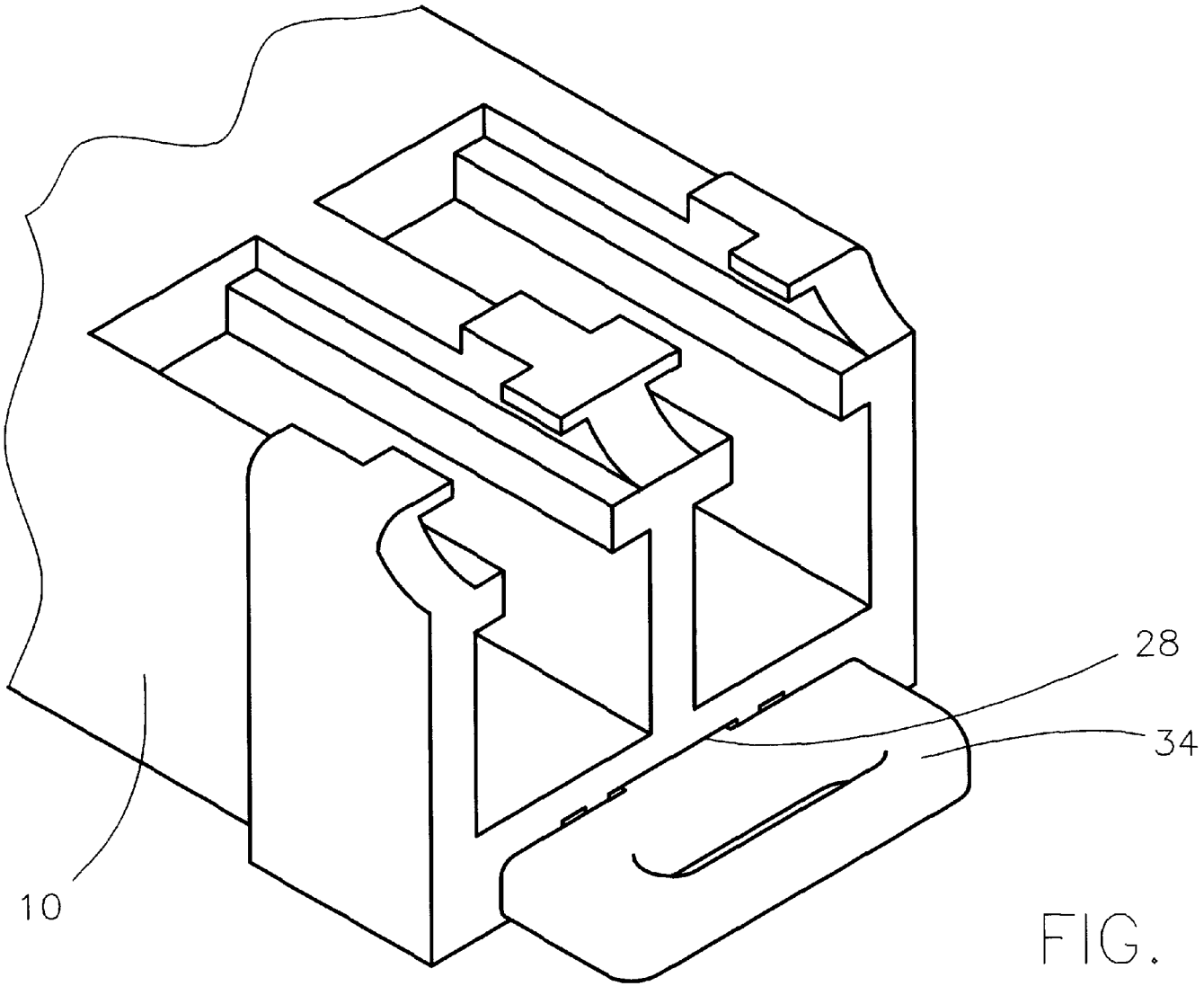
FIG. 5 is an isometric view of the external end of the transceiver module and the grip end of the latch release member of the latch mechanism of the invention.

FIG. 5 shows the pull tab 34 of the latch release member body 28 protruding from below transceiver module 10. This arrangements protects pull tab 34 and latch release member body 28 any time fiber optic cable 62 and ferrule 60 are connected to the transceiver module 10, as in FIG. 1.

Figure 6:
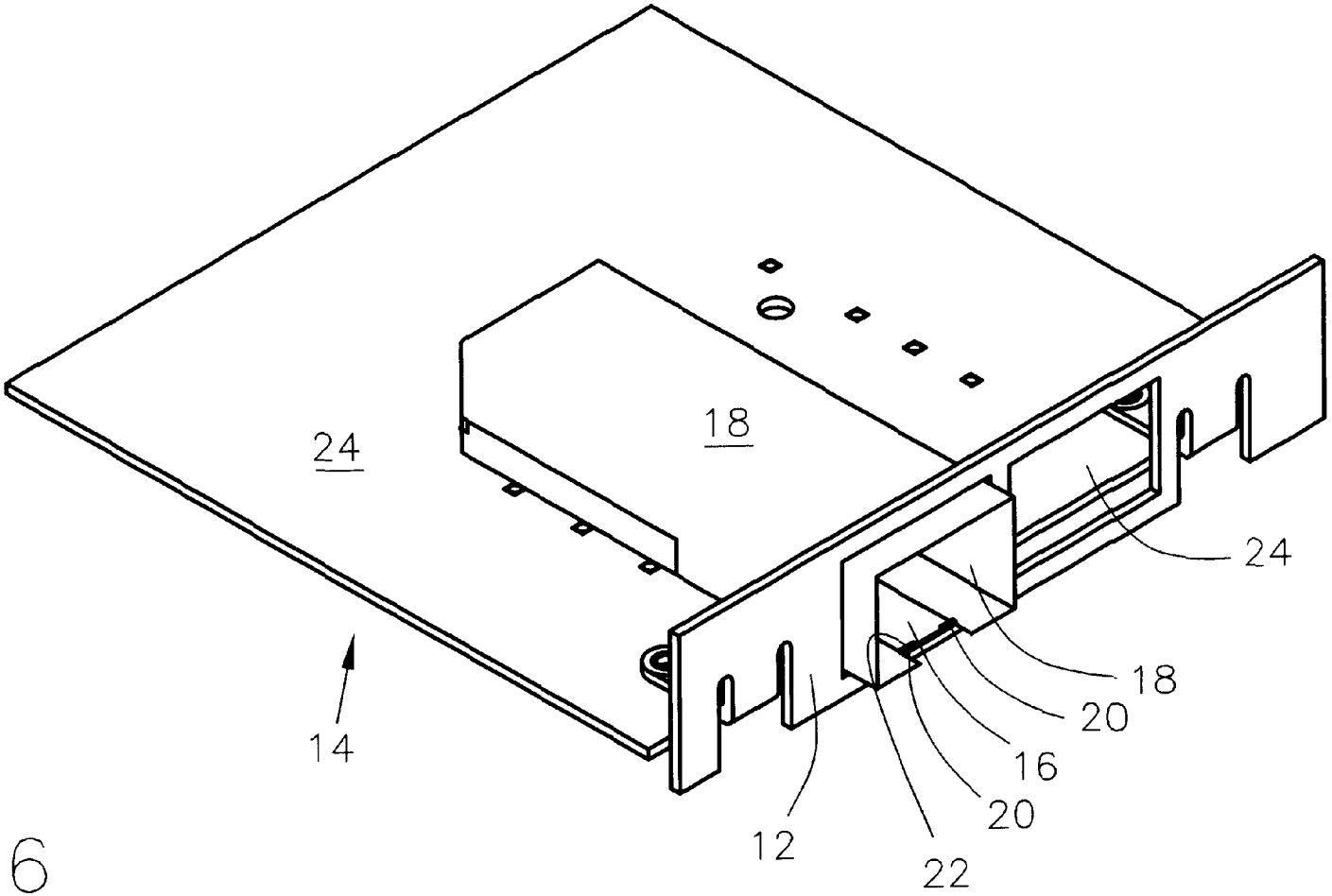
FIG. 6 is an isometric view of the host device and, particularly, the electro-magnetic interference shield and the latch member of the latch mechanism.

The operation of the latching mechanism of the invention involves the insertion of the transceiver module 10 into the host device 14, typically by inserting the transceiver module 10 into the electro-magnetic interference cage 18 and seating the transceiver module 10. Referring to FIG. 6, the host device 14, typically a computer or server, provides the latch member 16 for engagement with the latch release member 26, preferably in the form of a portion of the metal electro-magnetic interference cage 18 or other deflectable member in the form of a cantilevered beam spring 16. The latching portion 20 of the spring or latch member 16, extending inwardly toward the transceiver module 10, slides relative to the transceiver module 10 until passing the latch surface 32 of the transceiver module 10. Thereafter, the latch member 16 relaxes and flexes to dispose at least a portion 20 of the latch member 16 in a position to block or interfere with the withdrawal of the transceiver module 10. The latch member 16 extends into the recesses 30 on the body 28 of the latch release member 26. These actions are best seen in FIGS. 1 and 2.

With the transceiver module 10 being latched into position by engagement of portion 20 of latch member 16 with the latch surface 32 and the latch release member 26 fully retracted into the transceiver module 10, the latch member 16, particularly, portion 20 is resident in the recesses 30 in the latch release member 26.

Removal of the transceiver module 10 is accomplished by grasping and pulling the pull tab 34 of the latch release member 26. Whenever the latch release member 26 is translated generally left to right as occurs in FIG. 2, the sloping surfaces 48 engage the edge 21 of portion 20 of the latch member 16 and cause the deflection of the cantilevered beam spring 16 forming the support for the latch surface 22 on portion 20 of the latch member 16. Upon the deflection to the greatest extent possible by the sloped camming surfaces 48, the latch member 16 is disengaged from latch surface 32 and the transceiver module 10 may be extracted from the host device 14 by further pulling pull tab 34.

The spring arms 44 will flex relative to the transceiver module 10 to provide a restore movement for the latch release member 26. Once the latch release member 26 is fully translated for extraction, the spring arms 44 will engage a blocking surface 54 of recess 52; such engagement not only will prevent further movement of the latch release member 26 relative to the transceiver module 10 but also will transmit a force exerted on the latch release member 26 to transceiver module 10 to pull the transceiver module 10 from the host device 14 and disconnect the electronic connectors on both the transceiver module 10 and the host device 14.

The spring arms 44 and, particularly, the flexure regions 50 of the spring arms 44 may be sized to break away from the latch release member 26 if an excessive force is applied to the pull tab 34. This feature insures a weak link in a relatively inexpensive part that can be easily replaced if latch release member 26 is broken or defective.

FIG. 6 shows a portion of the host device 14 where the electro-magnetic interference cage 18 is mounted on a circuit board 24 within the host device or computer 14; the bottom portion of the electromagnetic interference cage 18 is partially severed longitudinally to form the latch member 16 with the upstanding portions 20 projecting toward or into the space that would be occupied by the transceiver module 10. The latch surface 22 of the latch 16 is the back side surface of the upstanding portions 20.

The latch member need not be a leaf spring as illustrated if a reciprocal latch member is desired. The same latching function could be attained by a spring-biased member supported by the bezel or housing of the host device. The spring-biased member could be a reciprocally moveable latch member biased by a separate spring and guided by a structure mounted on the interior of the housing.

Other modifications of various aspects of the invention may become apparent to one of skill in the art.

While the description of the invention has been made with reference to a transceiver module for purposes of the preferred embodiment, other electronic modules or devices may be latched by the use of this design of latch mechanism.

Each element of the invention is described with reference to at least one figure of the drawings and it should be understood that description is applicable to the same element in any figure, notwithstanding a lack of specific reference to the element in a particular figure.

The detailed description has been made for purposes of disclosure and may not be used to limit in any manner the scope of protection afforded by the attached claims which define the scope of the invention.

This description is made of the preferred embodiment of the invention but other embodiments of and modifications and changes to the described invention will come to mind of one skilled in the art, and the modifications and changes do not remove the resulting article from the scope of protection afforded the invention by the attached claims.

We claim:

1. A combination of a first body, a second body and a pull-to-release latch mechanism for latching a first body into a receiving portion of a second body, comprising:

said first body comprising a device having at least a first surface and a pair of surfaces defining wall surfaces;

said first surface interrupted by a recess formed into said first body comprising surfaces of said recess forming a channel, latch surface and a retention surface;

a slide member disposed within said channel and movable relative to said first body;

said slide member further constrained within said channel and being reciprocally displaceable relative to said first body and comprising at least an extended member resiliently attached to said slide member and disposed to be deflected by movement of said slide member, said extended member disposed in all interfering placement juxtaposed with said retention surface, providing an engagement between said extended member and said retention surface to retain said slide member and resiliently restore said slide member to a retracted position relative to said first body, said slide member further comprising at least one cavity formed in an exposed surface thereof, said cavity comprising at least one surface inclined relative to a direction of movement of said slide member relative to said first body and creating a progressively reduced depth of said cavity in a direction opposite to a direction of withdrawal of said slide member from said first body, and a displaceable latch member supported by said second body and projecting into said at least one cavity for disposal in a blocking relationship with said latching surface, said latch member engageable by said inclined surface upon movement of said slide member and said inclined surface in a direction outward from said second body, and displaceable out of said blocking relation with said latching surface, whereby a pulling movement of the slide will act to unlatch and subsequently extract said first body from said second body.

2. The pull-to-release latch mechanism for latching a first body into a receiving portion of a second body of claim 1 wherein said first body is an electronic module and said second body is an electronic host device.

3. The pull-to-release latch mechanism for latching a first body into a receiving portion of a second body of claim 2 wherein said electronic module further comprises retainers disposed adjacent said channel and engageable with said slide member for retaining said slide member in said reciprocal displaceability relationship with said electronic module.

4. The pull-to-release latch mechanism for latching a first body into a receiving portion of a second body of claim 2 wherein said extended member comprises a pair of arms resiliently disposed on said slide member and flexibly deformable by translation of said slide member in a direction of extraction of said electronic module from said host device.

5. The pull-to-release latch mechanism for latching a first body into a receiving portion of a second body of claim 2 wherein said latch member comprises a displaceable member supported on said host device.

6. The pull-to-release latch mechanism for latching a first body into a receiving portion of a second body of claim 5 wherein said displaceable member is a leaf spring.

7. The pull-to-release latch mechanism for latching a first body into a receiving portion of a second body of claim 6 wherein said leaf spring is formed to present a latching portion juxtaposed to said latching surface of said electronic module.

8. The pull-to-release latch mechanism for latching a first body into a receiving portion of a second body of claim 7 wherein said latching portion of said leaf spring is engaged by said inclined surface and forces said leaf spring to resiliently deform, removing said latching portion from a blocking position relative to said latch surface of said electronic module.

9. A combination of a first device, a second device and a pull-to-release latch mechanism for retaining said first device in and releasing said first device from said second device with a pulling motion comprising:

said second device forming a receiving region for receiving said first device, said first device comprising both a slidable latch release member extending outwardly from said first device and graspable by a human as well as a latch surface transverse to movement of said slidable latch release member;

said latch release member slidable relative to said first device in a direction substantially parallel to movement of said first device during insertion and removal of said first device into and from said second device, said second device comprising a moveable latch member positionable juxtaposed to said latch surface and engageable with said latch surface for preventing removal of said first device from said second device;

said latch release member comprising at least a recess disposed to accept at least a portion of said latch member whenever said first device is fully inserted into said second device, said recess further forming a cam surface engageable with said latch member forming a pull-to-release latch mechanism for retaining a first device in and releasing said first device from a second device with a pulling motion camming said latch member out of said juxtaposed position with said latch surface responsive to a pulling on said latch release member, thereby releasing said first device from said latch member for removal of said first device from said second device.

10. The pull-to-release latch mechanism for retaining a first device in and releasing said first device from a second device with a pulling motion of claim 9 wherein said latch release member is resiliently biased to a retracted position with respect to said first device.

11. The pull-to-release latch mechanism for retaining a first device in and releasing said first device from a second device with a pulling motion of claim 10 wherein said latch member comprises a formed cantilevered beam spring supported by said second device and deflectable relative thereto.

12. The pull-to-release latch mechanism for retaining a first device in and releasing said first device from a second device with a pulling motion of claim 11 wherein said first device is formed to create a recess therein and said latch release member is formed to possess a pair of opposingly extending resilient projections insertable within said recess and moveable to limited degree therein in response to movement of said latch release member relative to said first device, providing a resilient restore force for retracting said latch release member relative to said first device.

13. The pull-to-release latch mechanism for retaining a first device in and releasing said first device from a second device with a pulling motion of claim 12 wherein said first device comprises deformable retaining members engageable with said latch release members for accepting insertion of said latch release member into said first device and retaining said latch release member in slidable relationship to said first device.

* * * * *